United States Patent [19]

Prior et al.

[11] 4,121,518

[45] Oct. 24, 1978

[54] HIGH SPEED PRINTER HAMMER ASSEMBLY

[75] Inventors: Arthur D. Prior; Leonard G. Ward, both of Melbourne; Silas Ray Halbert, Indiatlantic, all of Fla.

[73] Assignee: Documation Incorporated, Melbourne, Fla.

[21] Appl. No.: 731,653

[22] Filed: Oct. 12, 1976

[51] Int. Cl.[2] ..... B41U 9/30

[52] U.S. Cl. ..... 101/93.33; 101/93.48; 335/266

[58] Field of Search ..... 101/93.09, 93.14, 93.29, 101/93.34, 93.48, 111; 335/256, 266, 268, 271, 276, 281, 11

[56] References Cited

U.S. PATENT DOCUMENTS

| | | | |
|---|---|---|---|
| 2,671,863 | 3/1954 | Matthews | 335/266 X |
| 2,997,632 | 8/1961 | Shepard | 101/93.33 X |
| 3,102,974 | 9/1963 | Williams | 335/266 X |
| 3,266,418 | 8/1966 | Russo | 101/93.34 X |
| 3,285,165 | 11/1966 | Richter | 101/93.32 |
| 3,629,755 | 12/1971 | Schaller | 335/271 |
| 3,633,500 | 1/1972 | Edwards | 101/111 |
| 3,636,865 | 1/1972 | Konkel et al. | 101/93.33 |
| 3,919,933 | 11/1975 | Potter | 101/93.32 |

*Primary Examiner*—Edward M. Coven

*Attorney, Agent, or Firm*—Duckworth, Hobby, Allen & Pettis

[57] ABSTRACT

A high speed printer is provided having a plurality of aligned hammer assemblies for directing hammers at a moving character band for printing characters responsive to the hammer's driving against the character band. The hammer assembly has a striker arm pivotly mounted to a striker assembly frame and which acts as an armature when driven by a pair of magnets. The magnets are attached to the striker assembly frame on opposite sides of the striker arm and on opposite sides of the pivot point for the striker arm so that simultaneously actuating both magnets pulls the striker arm for actuating the hammer. Each magnet has a single coil, with one of the magnets having a reverse polarity from each adjacent magnet on an adjacent assembly, while the other magnet has the same polarity to avoid cross-talk and to increase the speed of the printer. A pressure-sensitive tape is bonded to the striker armature to provide a residual air gap between the armature and magnet poles and improvements are made in the hammer guide combs, return plunger, and the platen.

19 Claims, 4 Drawing Figures

HIGH SPEED PRINTER HAMMER ASSEMBLY

BACKGROUND OF THE INVENTION

The present invention relates to printing hammer assemblies for high speed line printers which utilize a fast moving, steel character band and high speed hammer assemblies for hitting the band at the location of the appropriate characters on the band to print upon the band and especially to a combination of techniques for improving the operation and speed of the hammer assembly.

In the impact printing field, a wide variety of printing techniques have been used in the past including those employed in the ubiquitous typewriter: the drum printer, the wheel printer, and the chain or belt printer. In the present type of printer, an endless, steel character band having various characters of the alphabet as well as numbers embossed or raised upon the band, is rotated between a drive pulley and an idler pulley. As the band is driven at high speeds adjacent a platen, a bank of parallel hammers is driven at a high speed at the moment the particular desired character is passing on the band to print the character upon the paper. The print hammer actuators are typically electromagnetically actuated, such as by solenoids, which magnets are energized by the driving circuit with each pass of the character band. The hammer assemblies need to be spaced close to each other so that a large bank of hammers can fire as the band is passing; and each hammer must respond rapidly in view of the fast moving band which might otherwise smear the character if the hammer were operating at too slow a speed. Accordingly, the present invention is directed towards a hammer assembly of a high speed printer designed for increasing the speed of the actuators with an increased speed of the character band. To accomplish this, a number of techniques have been utilized to produce a printer that can print in excess of 2000 lines per minute with a 48 character set.

In the past, a variety of print hammer assemblies for high speed printers have been provided, and some of these may be seen in the following U.S. Pat. Nos. 3,144,821, to Drejza; 3,719,139, to Niccolai; 3,289,575, to Wassermann; 3,285,164, to Makavazos; 3,584,574, to Smith; 3,726,213, to Herbert; 3,707,122, to Cargill; 3,285,166, to Helms; 3,745,495, to Chai; 3,748,613, to Venker; 3,314,359, to Martin; 3,166,010, to Fradkin; 3,734,013, to Belser; 3,172,352, to Helms; 3,449,639, to Brown; 3,592,311, to Chou; 3,656,425, to Albo; 3,460,469, to Brown; 3,659,238, to Griffing; 3,630,142, to Fulks; and 3,502,190, to Smith.

In addition to these assemblies, one U.S. Pat. No. 3,285,165, to Richter, teaches a print hammer control apparatus for a high speed printer in which a plurality of print hammer actuators respond to a signal applied thereto for energizing adjacently flanking pairs of actuators with signals of substantially the opposite polarity. In this patent, each magnet has a pair of windings as in a typical hammer actuator format and cross-talk between adjacent print hammer actuators is controlled by the application of a field of opposite polarity adjacent each magnet. This is accomplished in one case by auxillary coils located between the hammer assemblies and in a second embodiment utilizing NRC circuit connection, connecting adjacent coils of opposite polarity. The present invention advantageously handles cross-talk by the placing of two magnets adjacent a striker with only one coil per magnet in the striker assembly, and thereafter having one of the magnets in each assembly of opposite polarity from the adjacent magnet while maintaining the second magnet of the same polarity in adjacent hammer assemblies, so that like magnets have cross-talk while unlike magnets of adjacent hammer assemblies have cross-talk substractive and effect a cancellation by equal amounts of additive and substractive cross-talk.

SUMMARY OF THE INVENTION

The present invention relates to a high speed line printer having a plurality of lined hammer assemblies for directing hammers at a moving character band for printing characters responsive to the hammer's driving against the character band. The hammer assembly has a striker assembly frame and an armature striker arm pivotly attached thereto for driving a hammer to print a character when actuated by the striker. The striker is driven by a pair of magnets located on either side of the striker armature arm with one magnet above the pivot point and one below the pivot point so as to simultaneously pull the striker bar. Each magnet has only a single coil and one of each pair of magnets has a polarity opposite that of an adjacently mounted magent on an adjacent hammer assembly while the other magnet has the same polarity as each adjacent magnet in each adjacent hammer assembly so as to reduce cross-talk between closely mounted hammer assemblies, and to increase the speed of the line printer. An improved platen working adjacent the rotating character band is provided along with improvements in the hammer assembly.

BRIEF DESCRIPTION OF THE DRAWINGS

Other objects, features, and advantages of the present invention will be apparent from the written description and the drawings in which.

DESCRIPTION OF THE PREFERRED EMBODIMENT

Figure 1:
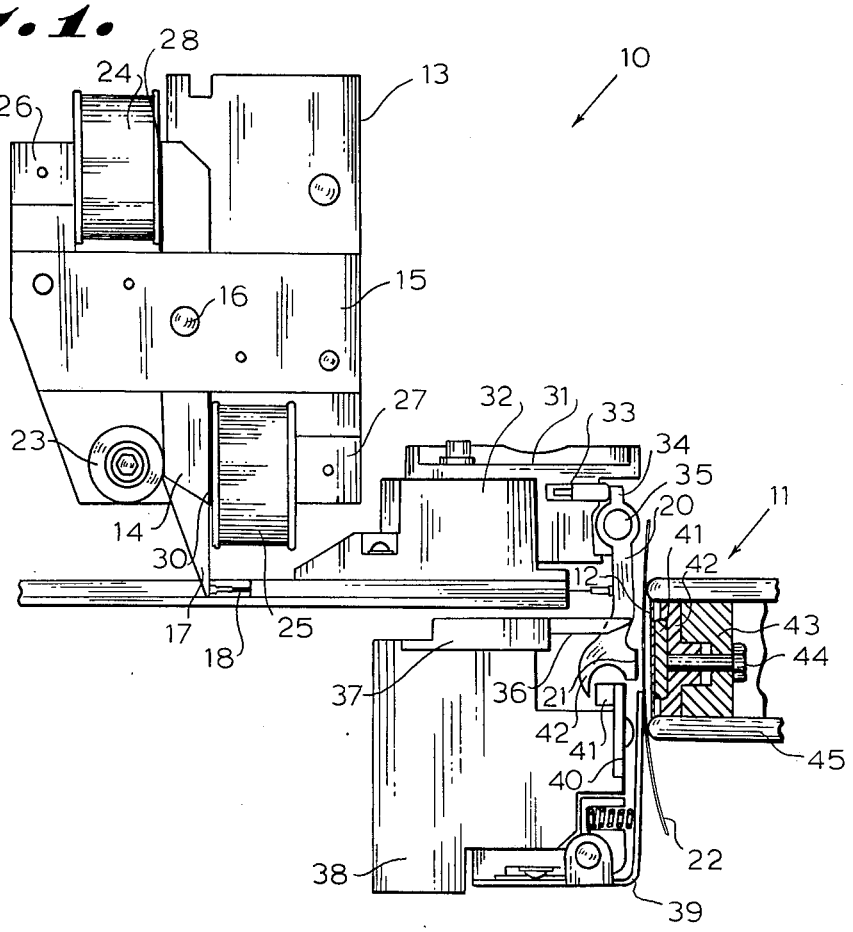
FIG. 1 is a sectional view of a hammer assembly and an adjacent platen.

Referring now to FIG. 1, a hammer assembly 10 for a high speed line printer is mounted adjacent a platen assembly 11 which has a high speed endless character band 12 rotating thereby between a drive roller and an idler roller (not illustrated). The hammer assembly 10 has a striker assembly 13 which drives a striker armature arm 14. The striker arm 14 is mounted to the striker assembly framework 15 by pin 16, so as to pivot on the pin 16, which allows the striking portion 17 of the striker arm 14 to drive a push-rod 18, which in turn, pushes a hammer 20 which hammer surface 21 is driven towards the character band 12 moving past the platen 11. Paper 22 rides between the character band and the hammer so that the hammer 21 is actuated in the proper sequence for a predetermined character on the character band 12 passing in front of the hammer and prints the character on the paper. The striker assembly 13 has an adjustable stop 23 holding the striker arm 14 in position.

A pair of electromagnet coils 24 and 25 are mounted to U-shaped magnetic cores 26 and 27 adjacent the striker arm 14. The coil 24 is mounted on the magnetic core 26 on one side of the striker arm 14 and above the pivot point 16 while coil 25 of magnetic core 26 is mounted on the opposite side of the striker arm 14 and below the pivot point 16 so that simultaneous actuation of the coils 24 and 25 will pull striker armature arm 14 towards each magnet thereby simultaneously driving striker arm 14. The striker arm maintains an air gap 28 and an air gap 30 between the striker arm which acts as the armature for both magnets and the tips of the cores 26 and 27. This residual air gap is assured with a pressure-sensitive tape bonded to the striker armature 14 to provide the residual air gap between the armature and the magnet poles in the striker assembly for the hammer bank 10. An air gap of between 0.003–0.005 inches must be provided between the armature and magnet poles so that the armature will release when the magnet coil is deenergized. This gap is called the residual air gap. Once the gap has been established, it is important that the gap remain constant within 0.0035–0.0045 inches for at least 100 million cycles of operation of the electromagnet. A 0.002 inch thick Kapton polyimide film backed with a 0.002 inch thick acrylic adhesive forms the air gap tape. The tape is applied to both air gap surfaces of the armature or striker arm 14. Pressure is applied to the tape and the tape armature is baked in an oven to cure the acrylic adhesive. The curing of the adhesive prevents the squeezing out of place of the tape by repeated operations of the electromagnets. Following the curing of the adhesive, the change in the air gap is in order of 0.0002 inch in one hundred million cycles. Curing a ploymer surface on the armature overcomes the problems of line printers which use a long tape which is passed through the air gaps of all electromagnets and which has a transport mechanism which continuously exposes a fresh section of residual air gap tape to the electromagnet poles. It thus prevents a change in the air gap due to the compacting of the tape. Thus, the present system eliminates the transport mechanism and tape replacement.

The hammer assembly 10 has a hammer module framework 31 having a hammer module mounting bar 32 and a hammer return spring and a cylindrical plunger 33 with a rounded tip and having the plunger adjacent a tab 34 on one end of the hammer 20. The hammer 20 is pivotedly mounted to hammer pivot shaft 35 mounted to the hammer frame 31 and rides between tines or teeth in a guide comb 36 which maintains the hammer in horizontal alignment and looks similar to a hair comb with protruding tines. The guide comb 36 is attached to a guide comb mounting bar 37 which is attached to the hammer assembly framework 32 and impression control support assembly 38. The forms compressor 39 is attached to the frame 38 and compresses the forms on paper being printed upon. The hammer 20 also works in conjunction with an impression control pad 40 having an impression surface 49 which is adjusted to receive a downwardly extending protrusion 42 of the hammer 20 to limit the thrust and travel of the hammer 20. The hammer return spring and plunger 33 immediately return the hammer following actuation, which in turn, throws a push-rod 18 back and the striker arm 14 away from the magnets 26 and 27. The hammer return plunger is made of a polyimide resin (Polymer SP-211) having a fluorocarbon resin added (10% polytrifluorochloroethylene) thereto, such as vespel, which provides a plastic material which is self-lubricating but long-lasting. Similarly, the platen surface 41 is made of the same material which ideally provides a long-lasting platen which has some resilience while providing self-lubrication and has been shown to out-last metal platens and plungers where different stresses are provided by a fast moving steel band being driven thereagainst by the hammer. The platen 11 is attached by an adhesive to a platen support 42 which is in turn attached to a support member 43 by a series of screws 44 which allows the platen surface 41 to be quickly changed following wear. The platen is mounted in a pair of ribbon guides 45 having a rounded surface which allows the ribbon paper to ride thereover and over the character band 12 but inside of the hammer 20. The guide comb teeth 36 are made of polyphenylene sulfide resin having pelletized glass material (40%), used as a filler and thereby providing a self-lubricating comb which can withstand high temperatures in guiding the hammer. The use of these new materials in the hammer assembly and platen advantageously reduces wear on the hammers and teeth, and increases the reliability and operation of the hammer assembly over that of the conventional metal components commonly used for similar purposes; and specifically avoids variations in hammer speed caused by friction and frictional wear and thereby provides hammer flight-time stability.

Figure 2:
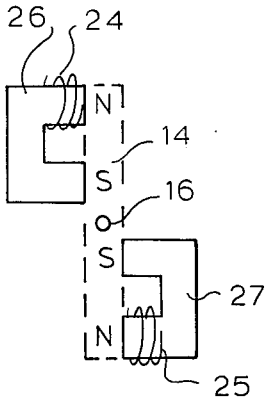
FIG. 2 is a diagrammatic view of one pair of magnets and armature.
Figure 3:
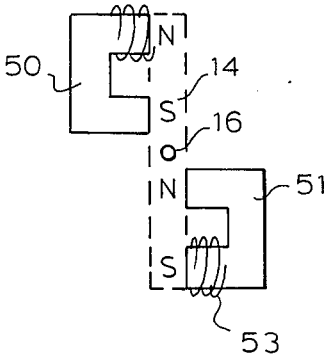
FIG. 3 is a diagrammatic view of a second pair of magnets and armature for an adjacent hammer assembly.
Figure 4:
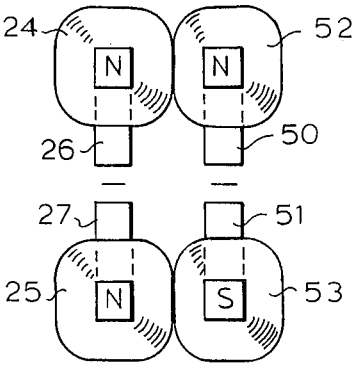
FIG. 4 places the pairs of magnets of FIGS. 2 and 3 adjacent each other in their normal mounted relationship.

Turning now to FIGS. 2 through 4, the operation of the magnets 26 and 27 in their coils 24 and 25 is illustrated in which the armature and striker bar 14 is mounted to its pivot point 16. The magnetic cores 26 and 27 are mounted as illustrated in FIG. 1 having electromagnetic coils 24 and 25. Only one coil 24 is used on the magnet 26 and only one coil 25 is used on the magnet 27. In addition, the cores 50 and 51 of FIG. 3 have coils 52 and 53 mounted in the same manner, and each pair of magnet assemblies of FIGS. 2 and 3 would be mounted adjacent each other. However, the magnets 26 and 50 are of the same polarity even though adjacent, while the magnets 27 and 51 are of opposite polarity, so that facing adjacent magnets provide a pair of magnetic poles as illustrated in FIG. 4. This arrangement provides magnets 26 and 50 with a cross-talk additive while the magnets 27 and 51 have a cross-talk substractive as relates to adjacent hammer assemblies. The mounting of adjacent hammer assemblies in this way has the cross-talk cancelling each other with the single armature experiencing equal amounts of additive and substractive cross-talk. Odd numbered magnetic coils may be connected for a series additive and even-numbered magnetic coils may be connected for series opposing cross-talk. This assembly advantageously eliminates cross-talk while maintaining a simplified magnet aramture design for driving closely mounted adjacent hammer assemblies thereby improving the speed of operation of the hammers which is further enhanced by the improvements in the hammer assembly 10 and platen assembly 11. It will, of course, be clear that a plurality of hammer assemblies 10 are mounted side by side along the front of the character band 12, but that since each hammer assembly must drive a hammer in front of the character band, the space available for the hammer assemblies is limited and thereby brings the magnetic structures closely adjacent each other and thereby allowing cross-talk between the hammer assembly and magnets interfering with the fast response and operation of the magnets. The present invention, however, is not to be construed as limited to the particular forms described herein, which are to be considered illustrative rather than restrictive.

I claim:

1. In a high speed printer, having a plurality of aligned hammer assemblies for directing hammers at a moving character band for printing characters responsive to said hammers driving against said character band, a hammer assembly comprising in combination:

a striker assembly frame;

an armature striker arm attached at a pivot point to said striker assembly frame to pivot thereon;

a pair of magnets attached to said striker assembly frame, at least one said magnet being attached on each side of said armature striker arm and on each side of said pivot point for simultaneously actuating said armature striker arm, each said magnet having a single coil, wrapped on a magnetic core; and one said magnet having a polarity opposite that of each adjacent one said magnet of each said adjacent hammer assembly, while each of said other magnets of said pair of magnets of said plurality of aligned hammer assemblies has the same polarity as each adjacent other magnet of each adjacent hammer assembly, thereby providing a high speed armature striker for a printer hammer assembly.

2. The apparatus in accordance with claim 1, in which each said magnet has a coil wrapped upon one arm of a U-shaped core.

3. The apparatus in accordance with claim 2, in which each coil of each magnet is wrapped around the core arm of each U-shaped core spaced the greatest distance from the pivot point of said armature.

4. The apparatus in accordance with claim 1, in which said striker armature arm is an elongated arm having a residual air gap of polyimide film bonded thereon.

5. The apparatus in accordance with claim 4, in which said polyimide film includes an acrylic adhesive applied thereto for holding the film to the armature for curing thereon.

6. The apparatus in accordance with claim 1, in which said armature striker arm has a striker portion thereon located to drive a push-rod against a hammer when said magnets are actuated.

7. The apparatus in accordance with claim 6, in which said push-rod is a sliding rod driving said hammer against a return plunger upon actuation of said magnets to drive said striker arm and push-rod.

8. The apparatus in accordance with claim 7, in which said hammer is guided in one direction by a guide comb, said guide comb being mounted to a hammer assembly frame, and said guide comb teeth being formed of a polyphenylene sulfide resin having a filler therein.

9. The apparatus in accordance with claim 7, in which said return plunger is made of a polyphenylene sulfide resin having a glass filler material therein.

10. The apparatus in accordance with claim 7, in which said hammer assembly is mounted adjacent a steel character band located adjacent a platen, said platen having a polyimide resin with a fluorocarbon resin filler therein.

11. A plurality of printer hammer actuating assemblies mounted adjacent to each other comprising;

a plurality of frames;

a plurality of armatures, each armature being pivotaly mounted to one said frame;

a first magnet attached to each said frame, and located adjacent an armature;

a second magnet attached to each said frame, and located adjacent an armature;

each said first magnet being of the same polarity as each adjacent first magnet on each adjacent hammer actuating assembly to generate additive cross-talk in each armature, and each said second magnet being of opposite polarity as each adjacent second magnet on each adjacent hammer actuating assembly to generate subtractive cross-talk in each said armature, whereby each armature experiences equal additive and subtractive cross-talk thereby cancelling cross-talk in each said armature.

12. The apparatus in accordance with claim 11, in each said first magnet and each said second magnet are located on opposite sides of each said armature pivot point from each other.

13. The apparatus in accordance with claim 12, in which each said armature has a hammer striker arm formed thereon.

14. The apparatus in accordance with claim 13, in which said armature has pressure-sensitive tape bonded thereto to provide a residual air gap between the armature and the magnet poles of said first magnet and second magnet in each hammer assembly.

15. The apparatus in accordance with claim 14, in which each armature residual air gap is formed of a polyimide film having an acrylic adhesive thereon.

16. The apparatus in accordance with claim 11, in which each said first and second magnets have a U-shaped magnetic core, each having a single coil wrapped around one arm thereof.

17. The apparatus in accordance with claim 16, in which each said first magnet coil is wrapped around the magnet core arm of said U-shaped core spaced the greatest distance from the pivot point of each said armature, and said second magnet coil is wrapped around the core arm spaced the greatest distance from said pivot point of said armature.

18. A hammer assembly for a high speed printer comprising in combination:

a frame;

a hammer mounted to pivot on said frame;

a guide comb having guide teeth made of polyphenylene sulfide resin, having a filler therein, said guide comb mounted to said frame for guiding said hammer;

a plunger made of a polyimide resin having a filler therein and being mounted to a hammer return spring adjacent said hammer for biasing said hammer in one direction;

a push-rod slidably mounted to said frame with one end butting against said hammer, and a second end butting against said striker for driving said hammer when actuated by said striker; and a platen assembly having a platen located adjacent said hammer on the opposite side of a character band, said platen being made of a polyimide resin having a filler therein, and being bonded to a platen support, said support being removably mounted to a platen support framework.

19. The apparatus in accordance with claim 18, in which said platen is made of a polyimide resin having a polytrifluorochloroethylene filler therein, and said plunger is made of a polyimide resin having a polytrifluorochloroethylene filler therein.

* * * * *